US012781405B2

(12) United States Patent
Hasegawa et al.

(10) Patent No.: US 12,781,405 B2
(45) Date of Patent: Nov. 3, 2026

(54) SEWING MACHINE

(71) Applicant: BROTHER KOGYO KABUSHIKI KAISHA, Nagoya (JP)

(72) Inventors: Katsuhisa Hasegawa, Kasugai (JP); Daisuke Ueda, Seto (JP); Takahira Osamura, Kitanagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 160 days.

(21) Appl. No.: 18/668,539

(22) Filed: May 20, 2024

(65) Prior Publication Data

US 2024/0401257 A1 Dec. 5, 2024

(30) Foreign Application Priority Data

May 30, 2023 (JP) ..... 2023-088465

(51) Int. Cl.

| | |
|---|---|
| ***D05B 21/00*** | (2006.01) |
| ***D05B 49/04*** | (2006.01) |
| ***D05B 69/12*** | (2006.01) |
| ***D05B 87/02*** | (2006.01) |

(52) U.S. Cl.

CPC ..... *D05B 21/00* (2013.01); *D05B 49/04* (2013.01); *D05B 69/12* (2013.01); *D05B 87/02* (2013.01)

(58) Field of Classification Search

CPC ..... D05B 21/00; D05B 49/04; D05B 69/12; D05B 87/02; D05B 19/08; D05B 19/085; D05B 19/105; D05B 73/00; D05B 73/02

See application file for complete search history.

(56) References Cited

U.S. PATENT DOCUMENTS

| | | | | | |
|---|---|---|---|---|---|
| 3,072,081 | A * | 1/1963 | Milligan | D05B 21/00 | 192/127 |
| 3,827,381 | A * | 8/1974 | Baanstra | D05B 69/24 | 112/470.03 |
| 4,150,634 | A * | 4/1979 | Brown | D05B 69/18 | 112/261 |
| 4,403,558 | A * | 9/1983 | Martell | D05B 69/20 | 112/272 |
| 5,195,451 | A * | 3/1993 | Nakashima | D05B 79/00 | 112/102.5 |

(Continued)

FOREIGN PATENT DOCUMENTS

| | | |
|---|---|---|
| JP | 2006-340958 A | 12/2006 |
| JP | 2008-259719 A | 10/2008 |
| JP | 2018-187077 A | 11/2018 |

*Primary Examiner* — Clinton T Ostrup
(74) *Attorney, Agent, or Firm* — Oliff PLC

(57) ABSTRACT

A sewing machine includes a column, a bed, an arm, and an input interface. The column extends in an upper-lower direction. The bed extends in a first particular direction from the column at a position above a lower end of the column. A first direction includes the first particular direction and a first opposite direction opposite to each other. The first direction is perpendicular to the upper-lower direction. The arm extends in the first particular direction from the column at a position spaced upward from the bed. The input interface is arranged on a front plate. The front plate is a plate located at an end of the arm in the first particular direction. The input interface is an interface for operating the sewing machine.

17 Claims, 4 Drawing Sheets

(56) References Cited

U.S. PATENT DOCUMENTS

| | | | | |
|---|---|---|---|---|
| 5,865,133 | A * | 2/1999 | Herbach | D05B 19/12 112/102.5 |
| 8,997,669 | B1 * | 4/2015 | Konzak | D05B 47/04 112/254 |
| 9,267,222 | B2 * | 2/2016 | Schnaufer | D05B 11/00 |
| 2006/0011121 | A1 * | 1/2006 | Fujihara | D05B 87/02 112/470.01 |
| 2006/0278147 | A1 | 12/2006 | Omiya et al. | |
| 2010/0186646 | A1 * | 7/2010 | Stokes | D05B 19/12 112/271 |
| 2012/0137943 | A1 * | 6/2012 | Mizuno | D05B 57/16 112/183 |
| 2015/0000575 | A1 * | 1/2015 | Kawaguchi | D05C 9/06 112/103 |

* cited by examiner

SEWING MACHINE

REFERENCE TO RELATED APPLICATIONS

This application claims priority from Japanese Patent Application No. 2023-088465 filed on May 30, 2023. The entire content of the priority application is incorporated herein by reference.

BACKGROUND ART

A sewing machine including an input interface for receiving input by a user is known.

SUMMARY

A sewing machine includes a column, a bed, an arm, and an input interface. The column extends in an upper-lower direction. The bed extends toward one side in an X direction from the column, where the X direction is a direction perpendicular to the upper-lower direction. The arm extends from the column toward one side in the X direction at a position spaced upward from the bed. The input interface is arranged on the plate located at one end of the arm in a Y direction, where the Y direction is a direction perpendicular to the upper-lower direction and the X direction.

For example, in a case where a user handles a sewing machine from one side in the X direction, in the above-mentioned configuration, since the input interface is arranged on a plate located at one end of the arm in the Y direction, there is a possibility that operability of the input interface by a user is deteriorated.

In view of the foregoing, an example of an object of this disclosure is to provide a sewing machine that contributes to suppressing deterioration of operability of an input interface by a user.

According to a first aspect, this specification discloses a sewing machine. The sewing machine includes a column, a bed, an arm, and an input interface. The column extends in an upper-lower direction. The bed extends in a first particular direction from the column at a position above a lower end of the column. A first direction includes the first particular direction and a first opposite direction opposite to each other. The first direction is perpendicular to the upper-lower direction. Thus, in a case where a workpiece has a tubular shape, for example, an embroidery frame holding the tubular workpiece is attached to a frame mount such that the bed is placed inside the tubular workpiece. This improves operability of the sewing machine when sewing the tubular workpiece. The arm extends in the first particular direction from the column at a position spaced upward from the bed. The input interface is arranged on a front plate. The front plate is a plate located at an end of the arm in the first particular direction. The input interface is an interface for operating the sewing machine. Since the input interface is arranged on the front plate that is located at the end of the arm in the first particular direction, operability of the input interface by the user is improved.

According to a second aspect, this specification discloses a sewing machine. The sewing machine includes a column, a bed, an arm, an input interface, and a carriage. The column extends in an upper-lower direction. The bed extends in a first particular direction from the column. A first direction includes the first particular direction and a first opposite direction opposite to each other. The first direction is perpendicular to the upper-lower direction. The arm extends in the first particular direction from the column at a position spaced upward from the bed. The input interface is arranged on a front plate. The front plate is a plate located at an end of the arm in the first particular direction. The input interface is an interface for operating the sewing machine. The carriage is movable in the first direction. The carriage includes a frame mount located between the bed and the arm in the upper-lower direction. An embroidery frame holding a sewing workpiece is configured to be attached to the frame mount. The frame mount is configured that the embroidery frame is attached to the frame mount by inserting the embroidery frame toward the first opposite direction.

According to the first aspect or the second aspect, the sewing machine contributes to suppressing deterioration of operability of the input interface by the user.

DESCRIPTION

Figure 1:
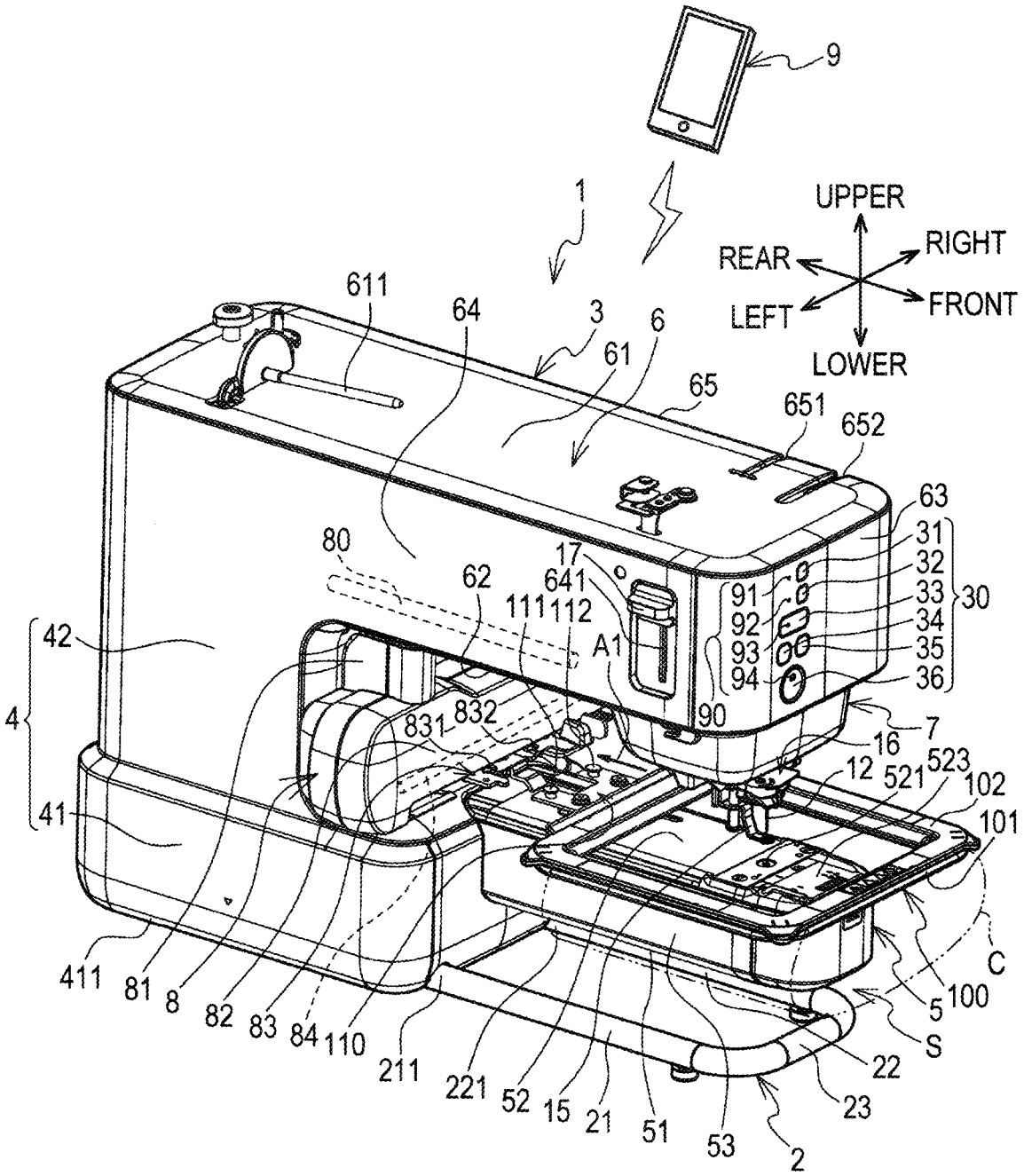
FIG. 1 is a perspective view of a sewing machine 1 as viewed from a left front upper side.

An embodiment of the present disclosure will be described below with reference to the drawings. The drawings referred to herein are used to explain technical features that may be adopted in the present disclosure. The configurations shown in the drawings are not intended to be limiting, but merely illustrative.

A sewing machine 1 will be described with reference to FIGS. 1 to 4. Hereinafter, an upper side, a lower side, a lower right side, an upper left side, a lower left side, and an upper right side in FIG. 1 are respectively referred to as an upper side, a lower side, a front side, a rear side, a left side, and a right side of the sewing machine 1. In the present embodiment, a front side of the sewing machine 1 is a front surface of the sewing machine 1.

Figure 2:
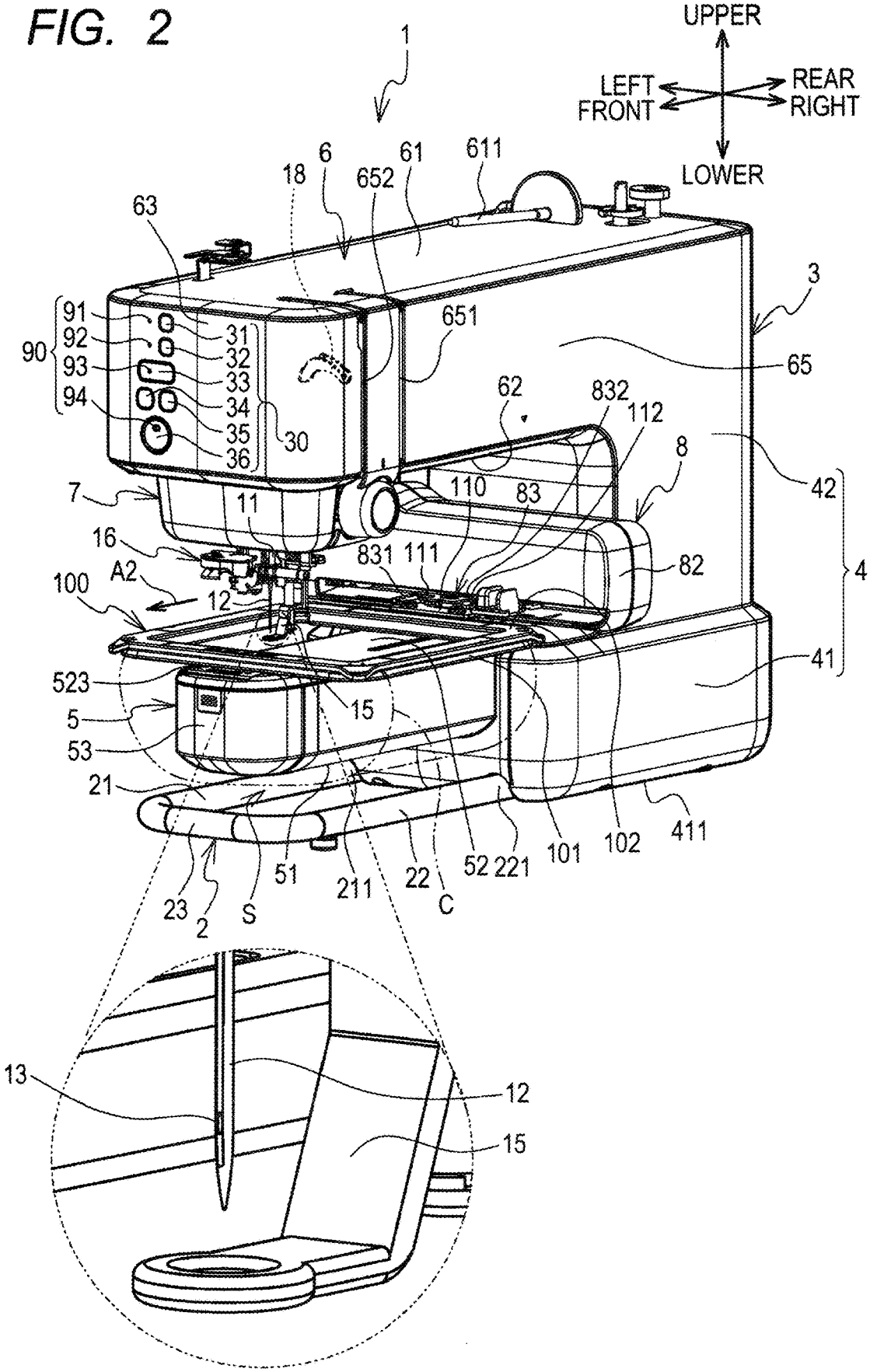
FIG. 2 is a perspective view of the sewing machine 1 as viewed from a right front upper side.

As shown in FIG. 1, the sewing machine 1 is an embroidery sewing machine that performs sewing on a sewing workpiece C held by an embroidery frame 100, based on sewing data received from an external device 9. The sewing workpiece C is a flexible sheet, and is, for example, a cloth. The external device 9 is a communication terminal such as a smartphone, a personal computer, or a tablet terminal. FIG. 1 shows a state before the embroidery frame 100 is attached to a carriage 8, and FIG. 2 shows a state after the embroidery frame 100 is attached to the carriage 8. The embroidery frame 100 is omitted in FIGS. 3 and 4.

Figure 3:
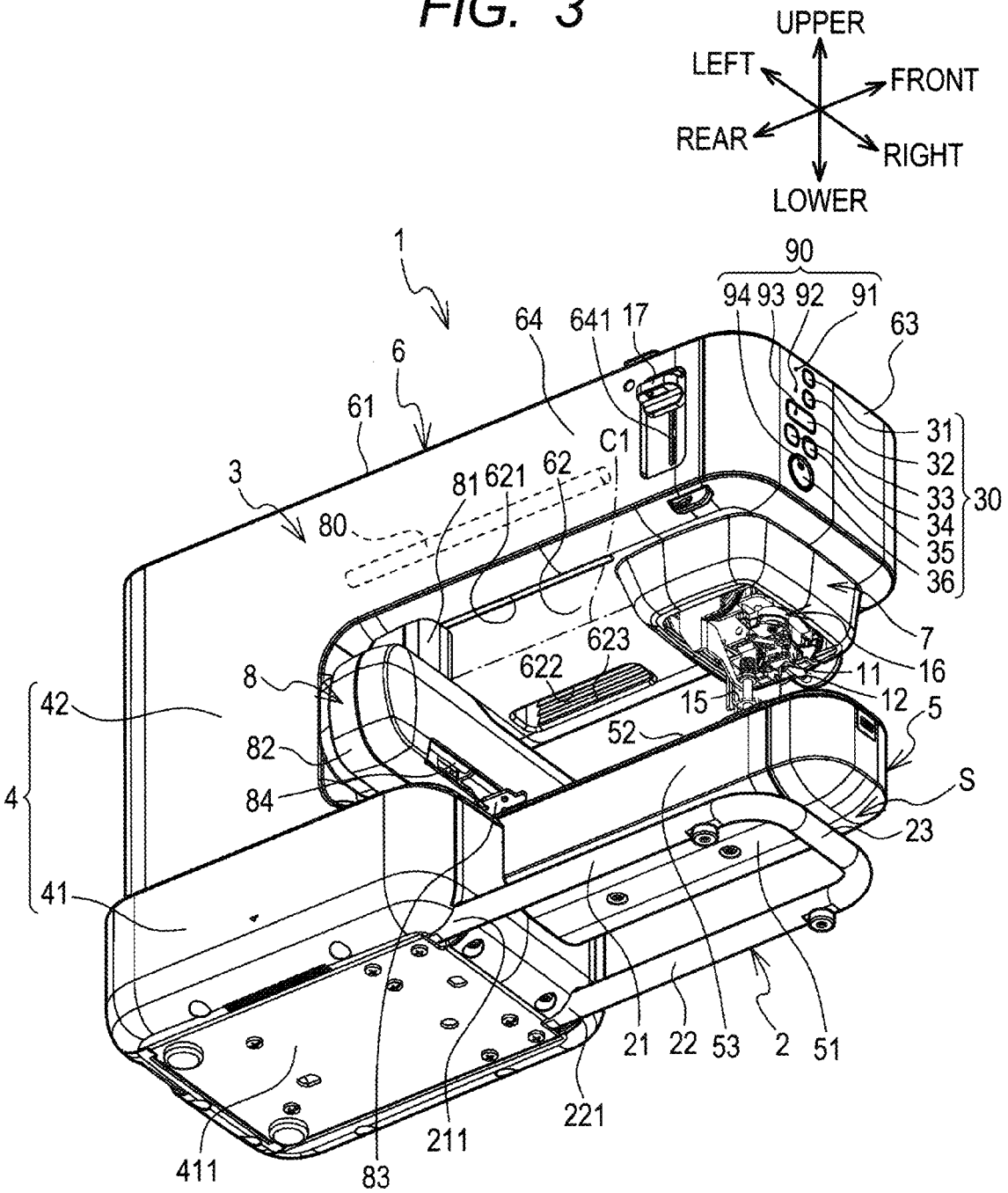
FIG. 3 is a perspective view of the sewing machine 1 as viewed from a left front lower side.

As shown in FIGS. 1 to 3, the sewing machine 1 is configured by a sewing machine frame (not shown) and a sewing machine cover 3. The sewing machine 1 includes a column (pillar) 4, a cylinder bed 5, an arm 6, and a head 7. The sewing machine frame is configured in a U-shape that is open forward in a side view. The sewing machine cover 3 is formed in a shape corresponding to the sewing machine frame, and covers the sewing machine frame with a plurality of plates.

The column 4 is located at a rear end of the sewing machine 1 and extends in the upper-lower direction. The column 4 includes an installation portion 41 and an extending portion 42. The installation portion 41 has a rectangular parallelepiped shape and includes a lower plate 411. The lower plate 411 is located at the lower end of the column 4 and extends in the front-rear direction and the left-right direction. The sewing machine 1 is installed such that the lower plate 411 is in contact with an installation stand (not shown) such as a table or a sewing machine stand. The extending portion 42 has a rectangular parallelepiped shape and extends upward from the installation portion 41.

The cylinder bed 5 is provided above the lower plate 411 and extends forward from the column 4. Since the cylinder bed 5 is located above the lower plate 411, a space S is formed below the cylinder bed 5. The cylinder bed 5 has a rounded rectangular shape in a front view, and includes a lower plate 51, an upper plate 52, and a side plate 53. The lower plate 51 is located at a lower end of the cylinder bed 5 and extends in the front-rear direction and the left-right direction. The upper plate 52 is located at an upper end of the cylinder bed 5 and extends parallel to the lower plate 411. The side plate 53 extends from a periphery of the lower plate 51 to a periphery of the upper plate 52, and constitutes a side surface of the cylinder bed 5.

In the present embodiment, the size of the cylinder bed 5 in the front-rear direction is larger than the size of the cylinder bed 5 in each of the left-right direction and the upper-lower direction. The size of the cylinder bed 5 in the left-right direction is smaller than the size of each of the installation portion 41 and the extending portion 42 in the left-right direction.

Figure 4:
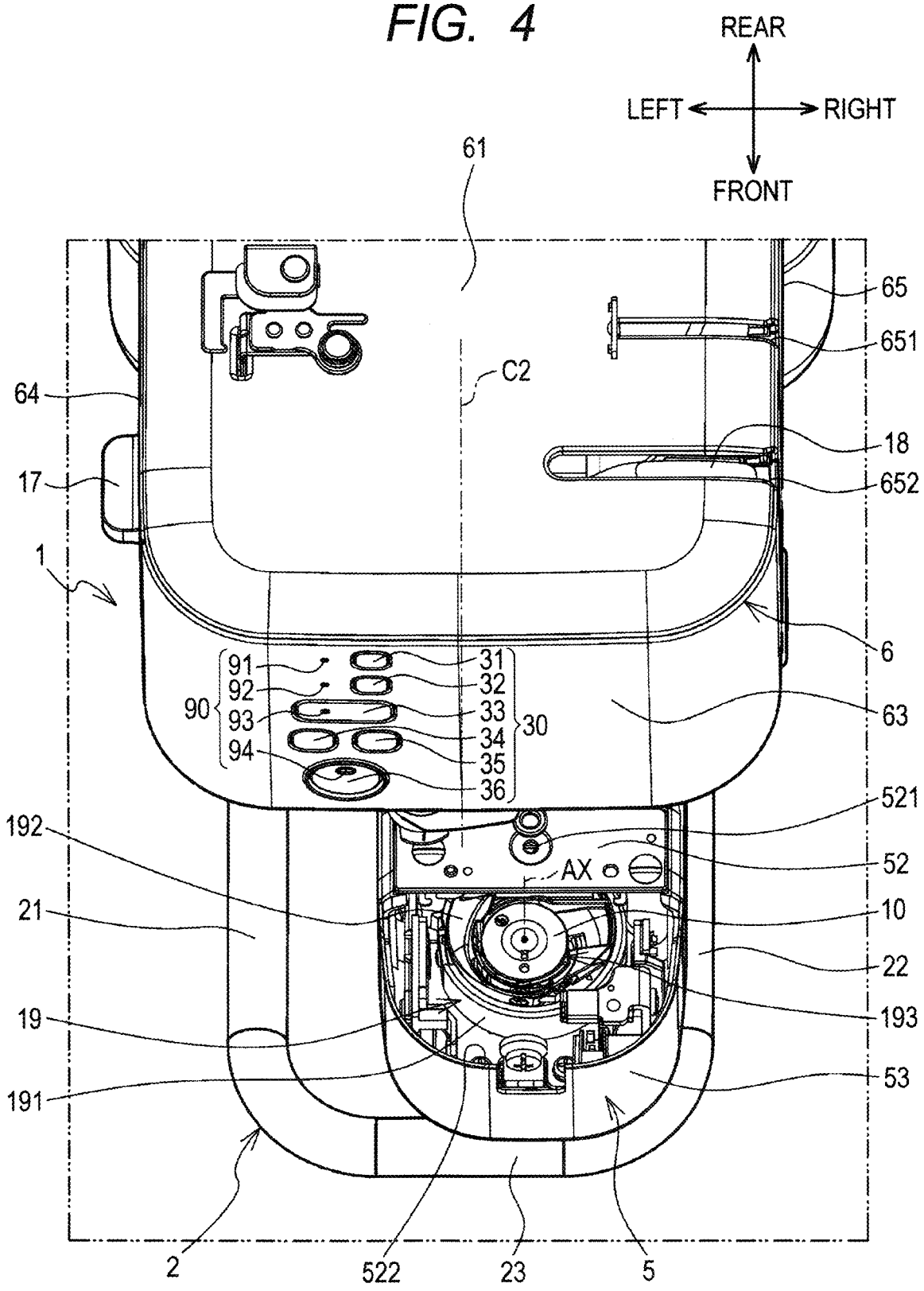
FIG. 4 is a perspective view of the sewing machine 1 from which a lid 523 has been removed, as viewed from a front upper side.

As shown in FIGS. 1 and 4, the upper plate 52 is formed with a needle hole 521 and an opening 522 (see FIG. 4). The needle hole 521 is located forward of the center of the upper plate 52 in the front-rear direction, and is located at the center of the upper plate 52 in the left-right direction. The needle hole 521 is formed to penetrate the upper plate 52 in the upper-lower direction. During sewing, a sewing needle 12 is inserted through the needle hole 521 in the upper-lower direction.

As shown in FIG. 4, the opening 522 is located forward of the needle hole 521 and is formed to penetrate the upper plate 52 in the upper-lower direction. The opening 522 has a D-shaped outer shape rounded at the front side thereof in a plan view, and is larger than the outer shape of an accommodating portion 193 described below. The lid 523 shown in FIG. 1 is provided at the opening 522. When the lid 523 is attached to the opening 522, the lid 523 covers the opening 522 (see FIG. 1). When the lid 523 is detached from the opening 522, the opening 522 is opened (see FIG. 4).

As shown in FIGS. 1 to 3, the arm 6 extends forward from the upper end of the column 4 and is arranged at a position spaced upward from the cylinder bed 5. The arm 6 has a rectangular parallelepiped shape and includes an upper plate 61, a lower plate 62, a front plate 63, a left plate 64, and a right plate 65. The upper plate 61 is located at the upper end of the arm 6 and extends in the front-rear direction and the left-right direction. The lower plate 62 is located at the lower end of the arm 6 and extends parallel to the upper plate 61. The lower plate 62 is arranged at a position spaced upward from the upper plate 52 so as to face the upper plate 52.

The front plate 63 extends from the front end of the upper plate 61 to the front end of the lower plate 62. The front plate 63 is located at the front end of the arm 6 and extends in the upper-lower direction and the left-right direction. The left plate 64 extends from the left end of the upper plate 61 to the left end of the lower plate 62. The left plate 64 is located at the left end of the arm 6 and extends in the upper-lower direction and the front-rear direction. The right plate 65 extends from the right end of the upper plate 61 to the right end of the lower plate 62. The right plate 65 is located at the right end of the arm 6 and extends parallel to the left plate 64.

As shown in FIG. 1, a holding shaft 611 is provided near the rear end of the upper plate 61. The holding shaft 611 is located leftward of the center of the upper plate 61 in the left-right direction. The holding shaft 611 extends in the front-rear direction and holds a thread spool (not shown) around which an upper thread is wound.

An opening 641 is formed near the front end of the left plate 64. The opening 641 is formed to penetrate the left plate 64 in the left-right direction and extends in a slit shape in the upper-lower direction. A lever 17 is arranged in the opening 641. The lever 17 protrudes from inside the arm 6 to the left of the left plate 64 through the opening 641. The lever 17 is supported by the sewing machine frame so as to be movable in the upper-lower direction along the opening 641. The function of the lever 17 will be described later.

As shown in FIG. 2, an opening 651 and an opening 652 are formed near the front end of the right plate 65. The opening 652 is located forward of the opening 651 and is aligned with the opening 651 in the front-rear direction. Each of the opening 651 and the opening 652 is formed to penetrate the right plate 65 in the left-right direction and extend in a slit shape in the upper-lower direction. The opening 651 guides the upper thread extending from the thread spool (not shown) from above to below. The upper thread guided by the opening 651 passes through the opening 652. A thread take-up lever 18 described later is arranged in the opening 652.

As shown in FIG. 3, an opening 621 is formed near the left end of the lower plate 62. The opening 621 is located leftward of a center C1 of the lower plate 62 in the left-right direction. The opening 621 is formed to penetrate the lower plate 62 in the upper-lower direction and extends in a slit shape in the front-rear direction. An extending portion (connecting arm) 81 described later is arranged in the opening 621.

A recess 622 is provided near the right end of the lower plate 62. The recess 622 is located rightward of the center C1 of the lower plate 62 in the left-right direction. That is, the recess 622 is located opposite to the opening 621 in the left-right direction with respect to the center C1. The recess 622 has a rectangular shape longer in the front-rear direction than in the left-right direction in a bottom view, and is recessed upward from the lower plate 62. The distance from the rear end of the recess 622 to the column 4 is smaller than the distance from the front end of the recess 622 to the front end of the arm 6.

The recess 622 has a size that allows the user to put his or her finger thereon. For example, the length of the recess 622 in the front-rear direction is not limited to a specific value, but is greater than or equal to 5 centimeters in the present embodiment. The width of the recess 622 in the left-right direction is not limited to a specific width, but is greater than or equal to 1 centimeter in the present embodiment. The depth of the recess 622 in the upper-lower direction is not limited to a specific depth, but is greater than or equal to 4 centimeters in the present embodiment. An inner surface of the recess 622 has been subjected to anti-slip processing. In the present embodiment, a plurality of irregularities 623 are formed on the inner surface of the recess 622. For example, the user inserts a finger into the recess 622 from the right side of the arm 6, and lifts the sewing machine 1 by placing the finger on the plurality of irregularities 623.

A plurality of input buttons 30 and a plurality of lamps 90 are arranged on the front plate 63. Each of the plurality of lamps 90 is an LED. The details of the plurality of input buttons 30 and the plurality of lamps 90 will be described later.

The head 7 extends downward from the vicinity of the front end of the arm 6. The lower end of the head 7 is arranged above the upper plate 52 so as to face the vicinity of the front end of the upper plate 52. The lower end of the head 7 is open.

As shown in FIG. 2, the sewing machine 1 includes the thread take-up lever 18, a needle bar 11, a presser foot 15, a threading mechanism (threader) 16, a horizontal hook 19 shown in FIG. 4, and a thread cutting mechanism (not shown). The thread take-up lever 18 is arranged in the arm 6 and is supported by the sewing machine frame. The thread take-up lever 18 is hook-shaped and is exposed to the right from the opening 652. The upper thread guided by the opening 651 is hooked on the thread take-up lever 18 in the opening 652. The thread take-up lever 18 moves up and down along the opening 652 by driving of a sewing machine motor (not shown). The thread take-up lever 18 pulls up the upper thread with which the lower thread is entangled, and adjusts the position of a knot between the upper thread and the lower thread.

The needle bar 11 is supported by the sewing machine frame and extends downward from the lower end of the head 7. A sewing needle 12 is attached to the lower end of the needle bar 11. The sewing needle 12 extends downward from the needle bar 11. The needle bar 11 moves up and down in conjunction with up-down movement of the thread take-up lever 18 by driving of the sewing machine motor. The sewing needle 12 moves up and down by the up-down movement of the needle bar 11. The range of movement of the sewing needle 12 includes a particular threading position (not shown) for threading by the threading mechanism 16 described later.

An eye 13 is formed at the lower end of the sewing needle 12. The eye 13 opens in the front-rear direction in a state where the sewing needle 12 is attached to the needle bar 11. The front of the sewing machine 1 is defined by the direction in which the eye 13 opens, for example. In the directions in which the eye 13 opens (the front and rear sides), the direction opposite to the column 4 with respect to the sewing needle 12 (the forward direction) is the front side of the sewing machine 1.

The presser foot 15 is a plate that is bent a plurality of times, and is arranged rearward of the needle bar 11. The presser foot 15 is supported by the sewing machine frame and extends downward and forward from the lower end of the head 7. A hole through which the sewing needle 12 passes is formed in the lower end of the presser foot 15. The presser foot 15 moves up and down by driving of a presser motor (not shown). The presser foot 15 presses the sewing workpiece C from above by moving down. The presser foot 15 is separated upward from the sewing workpiece C by moving up. The presser foot 15 intermittently presses the sewing workpiece C in conjunction with the up-down movement of the needle bar 11.

The range of movement of the presser foot 15 includes a particular retracted position (not shown) at which the presser foot 15 does not interfere with a threading operation of the threading mechanism 16 described later. When the presser foot 15 is located at the retracted position, for example, the lower end of the presser foot 15 is located below the eye 13 of the sewing needle 12.

The threading mechanism 16 is provided on the left side of the needle bar 11 and extends downward from the head 7. The threading mechanism 16 includes a hook. The upper thread is hooked on the hook. The threading mechanism 16 is driven by a threading motor (not shown) via a cam mechanism (not shown) to thread the upper thread through the eye 13. Specifically, the threading mechanism 16 is lowered to a particular operating position (not shown) in a state where the upper thread is hooked on the hook. When the sewing needle 12 is located at the threading position and the threading mechanism 16 is located at the operating position, the height of the hook of the threading mechanism 16 is the same as the height of the eye 13. In this state, the threading mechanism 16 rotates so that the hook is directed toward the eye 13, and the upper thread hooked on the hook passes through the eye 13. In this way, the threading mechanism 16 performs the threading operation.

As shown in FIG. 4, the horizontal hook 19 is arranged in the cylinder bed 5, and is located at a position overlapping the needle hole 521 in a plan view. The horizontal hook 19 includes an outer hook 191 and an inner hook 192. The outer hook 191 has a cylindrical shape with an open upper end, and is rotatably supported by the sewing machine frame. An axis AX of the outer hook 191 passes through the center of the outer hook 191 and extends in the upper-lower direction. The inner hook 192 has a cylindrical shape with an open upper end, and is arranged inside the outer hook 191. The inner hook 192 is fixed to the sewing machine frame so as not to be rotatable.

The accommodating portion 193 is formed inside the inner hook 192. The accommodating portion 193 is a space surrounded by the inner surface of the inner hook 192 and overlaps the opening 522 in a plan view. A bobbin 10 around which a lower thread (not shown) is wound is housed in the accommodating portion 193. The user opens the lid 523 shown in FIG. 1 and inserts the bobbin 10 into the accommodating portion 193 through the opening 522.

In the horizontal hook 19, the outer hook 191 rotates about the axis AX in conjunction with the up-down movement of the thread take-up lever 18 and the needle bar 11 by driving of the sewing machine motor (not shown). In the horizontal hook 19, the outer hook 191 rotates relative to the inner hook 192, thereby causing the upper thread that has passed through the needle hole 521 to be entangled with the lower thread that has been pulled out from the bobbin 10.

The thread cutting mechanism (not shown) includes a cutting blade and is arranged near the horizontal hook 19. The thread cutting mechanism cuts the lower thread and the upper thread, which are entangled with each other by the horizontal hook 19, with the cutting blade by driving of a thread cutting motor (not shown).

As shown in FIG. 1, the sewing machine 1 further includes a base 2, a carriage 8, and a controller (not shown). The base 2 is arranged at a position spaced downward from the cylinder bed 5 with the space S interposed therebetween. The base 2 is rod-shaped and includes extending portions 21 and 22 and a connecting portion 23. The extending portion 21 extends in the front-rear direction. A rear end 211 of the extending portion 21 is connected to the lower end of the column 4 and fixed to a portion near a left end of the lower plate 411. The extending portion 22 is located rightward of the extending portion 21 and extends in the front-rear direction. A rear end 221 of the extending portion 22 is connected to the lower end of the column 4 and fixed to a portion near a right end of the lower plate 411.

The connecting portion 23 extends in the left-right direction, and connects the front end of the extending portion 21 and the front end of the extending portion 22. The base 2 extends in a U-shape opening rearward in a plan view from the rear end 211 of the extending portion 21 to the rear end 221 of the extending portion 22. The base 2 supports the sewing machine 1 so that the sewing machine 1 does not fall forward or in the left-right direction.

The carriage 8 is formed in an L shape opening upward and rightward in a front view, and includes a carriage frame and a carriage cover. The carriage 8 includes the extending portion 81 and a frame mount (mount portion) 82. The extending portion 81 extends in the upper-lower direction, and extends from the inside of the arm 6 to a position below the lower plate 62 through the opening 621. The lower end of the extending portion 81 is located above the upper plate 52. A front-rear shaft 80 is provided in the arm 6. The front-rear shaft 80 extends in the front-rear direction and is fixed to the sewing machine frame. The extending portion 81 is supported by the front-rear shaft 80, and is configured to move in the front-rear direction along the front-rear shaft 80 by driving of a front-rear motor (not shown). In this way, the carriage 8 moves in the front-rear direction along the front-rear shaft 80.

The frame mount 82 is connected to the lower end of the extending portion 81, and extends rightward from the lower end of the extending portion 81. Thus, the frame mount 82 is located between the cylinder bed 5 and the arm 6 in the upper-lower direction. The frame mount 82 includes a left-right shaft 84 and an attachment portion 83. The left-right shaft 84 extends in the left-right direction in the frame mount 82 and is fixed to the carriage frame. The attachment portion 83 is supported by the left-right shaft 84 and extends forward from the left-right shaft 84. The attachment portion 83 moves in the left-right direction along the left-right shaft 84 by driving of a left-right motor (not shown).

A pair of engagement grooves 831 and 832 are formed in the front end of the attachment portion 83. The pair of engagement grooves 831 and 832 are arranged in the left-right direction, and each of the pair of engagement grooves 831 and 832 has a U-shape that opens forward. The embroidery frame 100 is attached to the frame mount 82 via the attachment portion 83.

The embroidery frame 100 includes an outer frame 101 and an inner frame 102, and the sewing workpiece C is held between the outer frame 101 and the inner frame 102. The embroidery frame 100 is not limited to a specific shape, but is rectangular in the present embodiment. The embroidery frame 100 is provided with an attachment plate 110. The attachment plate 110 protrudes rearward from the rear end of the embroidery frame 100 and has a U-shape that opens rearward in a plan view.

The attachment plate 110 is provided with a pair of protrusions 111 and 112. The protrusion 111 protrudes upward from an end of the attachment plate 110 on the obliquely rear left side. The protrusion 112 protrudes upward from an end of the attachment plate 110 on the obliquely rear right side. The pair of protrusions 111 and 112 fit into the pair of engagement grooves 831 and 832, respectively, from the front (see an arrow A1 shown in FIG. 1, and FIG. 2). Thus, the embroidery frame 100 is attached to the frame mount 82. In a state where the embroidery frame 100 is attached to the frame mount 82, the embroidery frame 100 is fixed by a lock mechanism (not shown) provided at the attachment portion 83.

The controller is arranged inside the sewing machine cover 3. The controller includes a CPU, a ROM, a RAM, and so on, and controls the sewing machine 1. Hereinafter, a plurality of motors provided in the sewing machine 1 will be collectively referred to simply as "plurality of motors". In the present embodiment, the plurality of motors include the sewing machine motor, the threading motor, the presser motor, the thread cutting motor, the front-rear motor, and the left-right motor. The plurality of motors are arranged inside the sewing machine cover 3, and are fixed to the sewing machine frame. The controller is electrically connected to the plurality of motors, the plurality of input buttons 30, the plurality of lamps 90, and the lever 17.

Each of the plurality of input buttons 30 and the lever 17 transmits, to the controller, an instruction corresponding to an operation. For example, when the lever 17 is operated, the lever 17 raises or lowers the presser foot 15 to the retracted position, and transmits, to the controller, an instruction to operate the threading mechanism 16 to perform threading. Each of the plurality of lamps 90 emits light in response to an instruction from the controller. The plurality of motors are driven based on the control by the controller when the plurality of input buttons 30 or the lever 17 is operated.

The details of the plurality of input buttons 30 and the plurality of lamps 90 will be described with reference to FIG. 4. Each of the plurality of input buttons 30 is operated by the user in order to operate the sewing machine 1. The plurality of input buttons 30 include a first connection button 31, a second connection button 32, a reset button 33, an up-down button 34, a thread cutting button 35, and a start-stop button 36. The first connection button 31 is located at the uppermost position among the plurality of input buttons 30. When the first connection button 31 is operated, the first connection button 31 transmits, to the controller, an instruction to enable communication connection of the sewing machine 1 with the external device 9 using a first wireless communication method. The first wireless communication method is not limited to a specific communication method, but is, for example, a communication method by Wi-Fi. The "Wi-Fi" is a registered trademark of Wi-Fi Alliance.

The second connection button 32 is located below the first connection button 31. When the second connection button 32 is operated, the second connection button 32 transmits, to the controller, an instruction to enable communication connection of the sewing machine 1 with the external device 9 by a second wireless communication method. The second wireless communication method is a communication method different from the first wireless communication method, and is, for example, a communication method by Bluetooth. The "Bluetooth" is a registered trademark of Bluetooth SIG, Inc.

The reset button 33 is located below the second connection button 32. When the reset button 33 is operated, the reset button 33 transmits, to the controller, an instruction to move movable portions of the sewing machine 1 to initial positions, or an instruction to cancel an error state. The movable portions of the sewing machine 1 are the needle bar 11, the extending portion 81, the attachment portion 83, and so on, that are operated by driving of the plurality of motors. In the present embodiment, when the sewing machine 1 is in the error state, the operations of the buttons other than the reset button 33 among the plurality of input buttons 30 are disabled.

The up-down button 34 and the thread cutting button 35 are located below the reset button 33 and arranged in the left-right direction. The thread cutting button 35 is located to the right of the up-down button 34. When the up-down button 34 is operated, the up-down button 34 transmits, to the controller, an instruction to move the needle bar 11 up and down. When the thread cutting button 35 is operated, the thread cutting button 35 transmits, to the controller, an instruction to perform a thread cutting operation by the thread cutting mechanism. The start-stop button 36 is located below the up-down button 34 and the thread cutting button 35. When the start-stop button 36 is operated, the start-stop button 36 transmits, to the controller, an instruction to start sewing or an instruction to stop sewing.

Each of the plurality of input buttons 30 is classified into either a first input button or a second input button. The first input button is a button for operating at least one of the plurality of motors. In the present embodiment, each of the reset button 33, the up-down button 34, the thread cutting button 35, and the start-stop button 36 corresponds to the first input button. All of the plurality of first input buttons are arranged on the left side of a center C2 of the front plate 63 in the left-right direction.

The second input button is a button for performing an operation different from the operation of the plurality of motors. In the present embodiment, each of the first connection button 31 and the second connection button 32 corresponds to the second input button. When the user operates the first connection button 31 or the second connection button 32, none of the plurality of motors is driven. All of the plurality of second input buttons are arranged on the left side of the center C2 of the front plate 63. Thus, in the present embodiment, all of the plurality of input buttons 30 are arranged on the left side of the center C2 of the front plate 63. No input interface is arranged on the right side of the center C2 of the front plate 63.

Each of the plurality of lamps 90 notifies the user of a status of the sewing machine 1. The plurality of lamps 90 include a first connection lamp 91, a second connection lamp 92, an error lamp 93, and an operation lamp 94. The first connection lamp 91 is located on the left side of the first connection button 31. The first connection lamp 91 emits light in a state where the sewing machine 1 is able to perform communication with the external device 9 by the first wireless communication method. The second connection lamp 92 is located on the left side of the second connection button 32. The second connection lamp 92 emits light in a state where the sewing machine 1 is able to perform communication with the external device 9 by the second wireless communication method.

The error lamp 93 is provided on the reset button 33. The error lamp 93 emits light when the sewing machine 1 is in an error state. The operation lamp 94 is provided on the start-stop button 36. The operation lamp 94 emits light in a state where the sewing machine 1 is able to perform sewing (sewable state).

An example of a method of using the sewing machine 1 by the user and a sewing operation by the sewing machine 1 will be described. The user operates the first connection button 31 or the second connection button 32 depending on the wireless communication method to be used. In this case, the controller sets the sewing machine 1 to a state where the sewing machine 1 is able to perform communication with the external device 9 using the first wireless communication method or the second wireless communication method. The user operates the external device 9 to cause the external device 9 to connect with the sewing machine 1 for communication. The user operates the external device 9 to transmit sewing data to the sewing machine 1. In this case, the controller receives the sewing data from the external device 9.

The user operates the reset button 33. In this case, the controller controls the plurality of motors to move the movable portions of the sewing machine 1 to initial positions. The user operates the up-down button 34. In this case, the controller controls the sewing machine motor to move the sewing needle 12 up or down to the threading position. In this state, the user operates the lever 17. In this case, the controller controls the threading mechanism 16 to thread the upper thread through the eye 13 of the sewing needle 12. In the present embodiment, the controller controls the presser motor to raise or lower the presser foot 15 to the retracted position. In this state, the controller controls the threading motor to operate the threading mechanism 16 to thread the upper thread through the eye 13.

The user attaches the embroidery frame 100 holding the sewing workpiece C to the carriage 8. Specifically, the user inserts the embroidery frame 100 between the cylinder bed 5 and the arm 6 from the front side toward the rear side (refer to the arrow A1 shown in FIG. 1). With this operation, the pair of protrusions 111 and 112 fit into the pair of engagement grooves 831 and 832, respectively, from the front side, and the embroidery frame 100 is attached to the frame mount 82 via the attachment portion 83. In this case, if the sewing workpiece C has a tubular shape, for example, the embroidery frame 100 is attached to the frame mount 82 such that the cylinder bed 5 is placed inside the tubular sewing workpiece C.

The user operates the start-stop button 36. In this case, the controller controls the sewing machine motor, the front-rear motor, and the left-right motor to perform sewing on the sewing workpiece C based on the sewing data received from the external device 9. In the present embodiment, the controller controls the sewing machine motor to move the needle bar 11 up and down and rotate the thread take-up lever 18 while pressing the sewing workpiece C with the presser foot 15. With this operation, the sewing needle 12 penetrates the sewing workpiece C, the upper thread is entangled with the lower thread, and a stitch is formed on the sewing workpiece C.

The controller controls the front-rear motor and the left-right motor to convey the embroidery frame 100 in the front-rear direction or the left-right direction, while forming stitches on the sewing workpiece C. With this operation, stitches having a shape based on the sewing data are formed on the sewing workpiece C. When finishing the sewing, the user operates the start-stop button 36. In this case, the controller stops driving the sewing machine motor, the front-rear motor, and the left-right motor. The user operates the thread cutting button 35. In this case, the controller controls the thread cutting motor to cut the thread by the thread cutting mechanism (not shown). The user detaches the embroidery frame 100 from the carriage 8 (see an arrow A2 in FIG. 2).

For example, an error such as thread breakage may occur during sewing. When an error is detected by an error detection sensor (not shown), the controller sets the sewing machine 1 to an error state and stops sewing. The error detection sensor is, for example, a sensor that detects the tension of the upper thread. The user performs an operation for resolving the error state. For example, when thread breakage occurs, the user operates the reset button 33 after threading the upper thread through the eye 13 again. In this case, the controller cancels the error state and enables the operation of the plurality of input buttons 30.

As described above, in the above-described embodiment, since the sewing machine 1 includes the cylinder bed 5, it is assumed that the sewing machine 1 performs sewing on the tubular sewing workpiece C. Thus, the user handles the sewing machine 1 from the front. In the sewing machine 1, the plurality of input buttons 30 are arranged on the front plate 63. This allows the user to easily operate the plurality of input buttons 30, as compared with a case where the plurality of input buttons 30 are arranged on the right plate 65 and so on. Thus, the arrangement positions of the plurality of input buttons 30 contribute to suppressing deterioration of the operability of the plurality of input buttons 30 by the user. Further, the arrangement positions of the plurality of input buttons 30 contribute to suppressing an increase in the size of the sewing machine 1, for example, compared with a case where an operation panel and so on is separately provided at a position that is separated from the front plate 63 in the left-right direction.

If the plurality of first input buttons are arranged to be scattered in the left-right direction, the operation range of the plurality of first input buttons by the user may be increased in the left-right direction. In this case, when the user operates at least one of the plurality of motors, it may be difficult for the user to operate the plurality of first input buttons with one hand. In the above-described embodiment, all of the plurality of first input buttons are arranged on the left side of the center C2 of the front plate 63. This suppresses an increase of the user's operation range of the plurality of first input buttons. Thus, the user easily operates the plurality of first input buttons with one hand when operating at least one of the plurality of motors. Thus, the arrangement position of the plurality of first input buttons contributes to improvement in operability of the plurality of first input buttons by the user.

In the above-described embodiment, all of the plurality of second input buttons are arranged on the left side of the center C2 of the front plate 63. This suppresses an increase of the user's operation range of the plurality of second input buttons. Thus, the user easily operates the plurality of second input buttons with one hand when performing an operation different from the operation of the plurality of motors. Thus, the arrangement positions of the plurality of second input buttons contribute to improvement in operability of the plurality of second input buttons by the user.

If the plurality of input buttons 30 are located on the same side as the thread take-up lever 18 with respect to the center C2 of the front plate 63 in the left-right direction, the thread take-up lever 18 may hinder the user from operating the plurality of input buttons 30. In the above-described embodiment, the opening 652 is formed in the right plate 65, and the thread take-up lever 18 is arranged in the opening 652. In this case, the plurality of input buttons 30 are located on the front plate 63 on the opposite side from the thread take-up lever 18 with respect to the center C2 in the left-right direction. Thus, the thread take-up lever 18 does not hinder the user from operating the plurality of input buttons 30. Thus, the relationship between the arrangement positions of the plurality of input buttons 30 and the thread take-up lever 18 contributes to improvement in operability of the plurality of input buttons 30 by the user.

If the plurality of input buttons 30 are located on the front plate 63 on the opposite side from the lever 17 with respect to the center C2 in the left-right direction, it is assumed that the user operates the lever 17 with one hand and operates the plurality of input buttons 30 with the other hand. In the above-described embodiment, the opening 641 is formed in the left plate 64, and the lever 17 is arranged through the opening 641. In this case, the plurality of input buttons 30 are located on the front plate 63 on the same side as the lever 17 with respect to the center C2 in the left-right direction. Thus, for example, after the user operates the lever 17 to thread the thread through the eye 13, the user easily operates the plurality of input buttons 30 with the same hand as the hand that operated the lever 17. Thus, the relationship between the arrangement positions of the plurality of input buttons 30 and the lever 17 contributes to improvement in operability of the plurality of input buttons 30 by the user.

In the above-described embodiment, the lever 17 has a function of raising and lowering the presser foot 15 in addition to a function of operating the threading mechanism 16. This allows the user to easily thread the thread through the eye 13 by operating the lever 17. Thus, the lever 17 contributes to the user's easy operation of threading the thread through the eye 13.

In the above-described embodiment, the opening 522 for inserting the bobbin 10 in the horizontal hook 19 is formed in the upper plate 52. In this case, the user operates the sewing machine 1 from the front, and thus, the user easily inserts the bobbin 10 in the horizontal hook 19 through the opening 522. Thus, the arrangement position of the opening 522 contributes to the user's easy operation of inserting the bobbin 10 into the horizontal hook 19.

In the above-described embodiment, the recess 622 is formed in the lower plate 62. This allows the user to place a finger on the recess 622 to lift the sewing machine 1. Thus, the recess 622 contributes to the user's easy operation of carrying the sewing machine 1.

In the above-described embodiment, the extending portion 81 extends from the inside of the arm 6 to the outside of the arm 6 via the opening 621. Assume a case that the opening 621 and the recess 622 are located on the same side with respect to the center C1 of the lower plate 62 in the left-right direction. In this case, when the user turns his or her arm around the arm 6 from the side of the opening 621 with respect to the center C1 of the lower plate 62 and puts his or her fingers on the recess 622, the extending portion 81 may hinder the user from gripping the recess 622. In the above-described embodiment, the opening 621 is located leftward of the center C1 of the lower plate 62, and the recess 622 is located rightward of the center C1 of the lower plate 62. That is, the opening 621 and the recess 622 are located opposite to each other with respect to the center C1 of the lower plate 62 in the left-right direction. This suppresses the extending portion 81 hindering the user from gripping the recess 622. Thus, the relationship of the arrangement position of the recess 622 with respect to the opening 621 contributes to the user's easy operation of gripping the recess 622.

In the above-described embodiment, the carriage 8 is connected to the arm 6 on the left side with respect to the center C1 in the left-right direction (see FIG. 3). The carriage 8 is not connected to the arm 6 on the right side with respect to the center C1 in the left-right direction. That is, the carriage 8 is connected to the arm 6 only on the left side with respect to the center C1 in the left-right direction (cantilever carriage). The thread take-up lever 18 is arranged in the opening 652 formed in the right plate 65. Since a mechanism for moving the carriage 8 is arranged on the left side in the arm 6 and a mechanism for the thread take-up lever 18 is arranged on the right side in the arm 6, the space in the arm 6 is utilized efficiently.

In the above-described embodiment, the embroidery frame 100 is attached to the frame mount 82 by inserting the embroidery frame 100 from the front. Thus, the direction in which the user attaches the embroidery frame 100 to the frame mount 82 (the direction from the front to the rear) is the same as the direction in which the user operates the plurality of input buttons 30 (the direction from the front to the rear). Thus, after attaching the embroidery frame 100 to the frame mount 82 from the front toward the rear, for example, the user easily operates the plurality of input buttons 30. Thus, the relationship between the arrangement positions of the plurality of input buttons 30 and the attaching direction of the embroidery frame 100 to the frame mount 82 contributes to improvement in operability of the plurality of input buttons 30 by the user.

In the above-described embodiment, the base 2 extends in a U-shape opening rearward from the rear end 211 to the rear end 221, and the rear ends 211 and 221 are connected to the column 4. In this case, the base 2 is lighter than, for example, a D-shaped plate without an opening. Further, a portion of the sewing workpiece C that hangs down below the cylinder bed 5 is arranged in the open area surrounded by the base 2 in a plan view. Thus, the base 2 is less likely to hinder sewing, for example, as compared with a case of a D-shaped plate without an opening. Thus, the shape of the base 2 contributes to a reduction in the weight of the sewing machine 1 and smooth sewing.

In the above-described embodiment, the embroidery frame 100 is attached to the frame mount 82 by inserting the embroidery frame 100 from the front. Thus, the user handles the sewing machine 1 from the front. Since the plurality of input buttons 30 are arranged on the front plate 63, the user easily operates the plurality of input buttons 30 as compared with a case where the plurality of input buttons 30 are arranged on the right plate 65 and so on. Thus, the arrangement positions of the plurality of input buttons 30 contribute to suppressing deterioration of the operability of the plurality of input buttons 30 by the user. Further, the arrangement positions of the plurality of input buttons 30 contributes to suppressing an increase in the size of the sewing machine 1, for example, compared with a case where an operation panel and so on is separately provided at a position that is separated from the front plate 63 in the left-right direction.

In the above-described embodiment, the column 4 corresponds to a "column" of the present disclosure. The front-rear direction of the sewing machine 1 corresponds to a "first direction" of the present disclosure. The front side of the sewing machine 1 corresponds to a "first specific direction" of the present disclosure. The cylinder bed 5 corresponds to a "bed" of the present disclosure. The arm 6 corresponds to an "arm" of the present disclosure. The front plate 63 corresponds to a "front plate" of the present disclosure. Each of the plurality of input buttons 30 corresponds to an "input interface" of the present disclosure.

The plurality of motors correspond to "at least one motor" of the present disclosure. The first input button corresponds to a "first input interface" of the present disclosure. The left-right direction of the sewing machine 1 corresponds to a "second direction" of the present disclosure. The center C2 corresponds to a "first center (front-plate center)" of the present disclosure. The left side of the sewing machine 1 corresponds to a "second specific direction" of the present disclosure. The second input button corresponds to a "second input interface" of the present disclosure. The right plate 65 corresponds to a "first side plate" of the present disclosure. The opening 652 corresponds to a "first opening (take-up opening)" of the present disclosure. The thread take-up lever 18 corresponds to a "thread take-up lever" of the present disclosure. The left plate 64 corresponds to a "second side plate" or "particular side plate" of the present disclosure. The opening 641 corresponds to a "second opening (lever opening)" of the present disclosure. The threading mechanism 16 corresponds to a "threading mechanism" of the present disclosure. The lever 17 corresponds to a "lever" of the present disclosure. The presser foot 15 corresponds to a "presser foot" of the present disclosure. The retracted position corresponds to a "particular position" of the present disclosure.

The horizontal hook 19 corresponds to a "horizontal hook" of the present disclosure. The upper plate 52 corresponds to an "upper plate" of the present disclosure. The opening 522 corresponds to a "third opening (hook opening)" of the present disclosure. The lower plate 62 corresponds to a "lower plate" of the present disclosure. The recess 622 is an example of a "recess" of the present disclosure. The center C1 corresponds to a "second center (lower-plate center)" of the present disclosure. The opening 621 corresponds to a "fourth opening (carriage opening)" of the present disclosure. The front-rear shaft 80 corresponds to a "support shaft" of the present disclosure. The extending portion 81 corresponds to an "extending portion" of the present disclosure. The frame mount 82 corresponds to a "frame mount" of the present disclosure. The carriage 8 corresponds to a "carriage" of the present disclosure. The base 2 corresponds to a "base" of the present disclosure.

While the disclosure has been described in conjunction with various example structures outlined above and illustrated in the figures, various alternatives, modifications, variations, improvements, and/or substantial equivalents, whether known or that may be presently unforeseen, may become apparent to those having at least ordinary skill in the art. Accordingly, the example embodiments of the disclosure, as set forth above, are intended to be illustrative of the disclosure, and not limiting the disclosure. Various changes may be made without departing from the spirit and scope of the disclosure. Thus, the disclosure is intended to embrace all known or later developed alternatives, modifications, variations, improvements, and/or substantial equivalents. Some specific examples of potential alternatives, modifications, or variations in the described disclosure are provided below. The various modifications described below may be combined with each other as long as no contradiction occurs.

The shape of the base 2 is not limited to a U-shape, and may be, for example, a T-shape, a plurality of (for example, a pair of) rod-like shapes extending in the front-rear direction, or a rectangular plate-like shape.

In the above-described embodiment, the frame mount 82 has a configuration that the embroidery frame 100 is attached from the front toward the rear. The frame mount 82 is not limited to the configuration of the above-described embodiment. For example, the attachment portion 83 may include a protrusion protruding forward or upward instead of the pair of engagement grooves 831 and 832. In this case, an engagement portion may be provided on the attachment plate 110 of the embroidery frame 100, and the embroidery frame 100 may be attached to the frame mount 82 from the front such that the protrusion of the frame mount 82 fits to the engagement portion of the attachment plate 110. The engagement portion of the attachment plate 110 is a groove, a coupler, and so on. The frame mount 82 may be configured such that the embroidery frame 100 is attached from a direction other than the front (for example, from the left or from above).

The opening 621 and the recess 622 may be arranged on the same side (for example, the left side) with respect to the center C1 in the left-right direction in the lower plate 62. The lower plate 62 may not be formed with the recess 622. The lower plate 62 may not be formed with the opening 621. In a case where the opening 621 is not formed in the lower plate 62, the carriage 8 may move in the front-rear direction with a structure different from that of the above-described embodiment. For example, the front-rear shaft 80 may be arranged in the cylinder bed 5. The size and shape of the recess 622 are not limited to those in the above-described embodiment. For example, the recess 622 may be longer in the left-right direction than in the front-rear direction and may extend across the center C1.

The sewing machine 1 may include a vertical hook instead of the horizontal hook 19. In this case, the opening 522 for inserting the bobbin 10 into the vertical hook may be provided in the side plate 53 instead of the upper plate 52.

The lever 17 may not have a function of moving the presser foot 15 up and down. In this case, the sewing machine 1 may include a lever for moving the presser foot 15 up and down, separately from the lever 17.

The plurality of input buttons 30 and the lever 17 may be arranged on opposite sides with respect to the center C2 in the left-right direction. For example, the opening 641 in which the lever 17 is arranged may be formed in the right plate 65 instead of the left plate 64. The operation direction of the lever is not limited to the above-described embodiment. The threading mechanism 16 is not limited to the configuration of the above-described embodiment as long as the upper thread is threaded through the eye 13.

The plurality of input buttons 30 and the thread take-up lever 18 may be arranged on the same side (for example, the left side) with respect to the center C2 in the left-right direction. For example, the opening 652 in which the thread take-up lever 18 is arranged may be formed in the left plate 64 instead of the right plate 65.

In the above-described embodiment, the number of the second input buttons is plural. In contrast, the number of second input buttons may be one. Further, the plurality of input buttons 30 may include, as the second input button, a button having another function instead of or in addition to one or both of the first connection button 31 and the second connection button 32. The other functions are, for example, a function of starting receiving the sewing data and a function of disconnecting the communication connection between the sewing machine 1 and the external device 9.

All of the plurality of second input buttons may be arranged on the right side of the center C2. Some of the plurality of second input buttons may be arranged on the left side of the center C2, and the other of the plurality of second input buttons may be arranged on the right side of the center C2.

In the above-described embodiment, the number of the first input buttons is plural. In contrast, the number of first input buttons may be one. Further, the plurality of input buttons 30 may include, as the first input button, a button having another function instead of or in addition to some or all of the reset button 33, the up-down button 34, the thread cutting button 35, and the start-stop button 36. The other function is, for example, a function of winding the lower thread around the bobbin 10.

All of the plurality of first input buttons may be arranged on the right side of the center C2. Some of the plurality of first input buttons may be arranged on the left side of the center C2, and the other of the plurality of first input buttons may be arranged on the right side of the center C2.

In the above-described embodiment, the number of input buttons 30 is plural. In contrast, the number of input buttons 30 may be one. In this case, the input button 30 may be either the first input button or the second input button. The input button 30 may be provided on the front plate 63, on the left side or the right side of the center C2, or on the center C2. The number and the arrangement positions of the lamps 90 may be changed similarly to the input buttons 30.

The sewing machine 1 may include an input interface such as a touch panel instead of or in addition to the plurality of input buttons 30. The present disclosure does not exclude a case where another input interface is provided at a position (for example, the right plate 65) other than the front plate 63 as long as at least one input interface is provided on the front plate 63.

In the above-described embodiment, the cylinder bed 5 extends forward from a position above the lower end of the column 4. In contrast, the sewing machine 1 may include a bed that extends forward from the lower end of the column 4 instead of the cylinder bed 5, and the space S may not be formed below the bed. In this case, the base 2 may be omitted from the sewing machine 1. The bed may be configured such that a part of the bed is detachable from the other part of the bed. In this case, the bed may have a configuration (so-called free arm) in which the detachable portion is detached from the other part of the bed to form the space S below the other part of the bed.

In the above-described embodiment, when the first input button or the lever 17 is operated, the controller controls at least one of the plurality of motors. In contrast, when the first input button or the lever 17 is operated, at least one of the plurality of motors may be turned on or off without being controlled by the controller. Further, for example, the threading mechanism 16 and the thread cutting mechanism may be mechanisms that operate non-electrically, without depending on the threading motor and the thread cutting motor, respectively, or may be mechanisms that operate by other actuators such as a solenoid. For example, when the thread cutting mechanism is operated by a solenoid or non-electrically, the thread cutting button 35 corresponds to the second input button.

What is claimed is:

1. A sewing machine comprising:

a column extending in an upper-lower direction;

a bed extending in a first particular direction from the column at a position above a lower end of the column, a first direction including the first particular direction and a first opposite direction opposite to each other, the first direction being perpendicular to the upper-lower direction;

an arm extending in the first particular direction from the column at a position spaced upward from the bed, the arm including a first side plate and a second side plate, the first side plate extending in the first particular direction and in the upper-lower direction, the second side plate extending in the first particular direction and in the upper-lower direction, the second side plate being spaced apart from the first side plate; and an input interface on a front plate, the front plate being a plate at an end of the arm in the first particular direction, the front plate extending to an end of the first side plate in the first particular direction and extending to an end of the second side plate in the first particular direction, the front plate extending in the upper-lower direction and in a second direction, the second direction being perpendicular to the upper-lower direction and the first direction, the input interface being an interface for operating the sewing machine, and the input interface including a button for instructing at least to start sewing or to stop sewing, wherein a recess is in a lower plate, the lower plate being a plate at a lower end of the arm, the recess being recessed upward;

a carriage opening is in the lower plate, the carriage opening being on a particular side on the lower plate with respect to a lower-plate center in the second direction, the second direction including a second particular direction and a second opposite direction opposite to each other, the particular side being a side toward the second particular direction;

the sewing machine further comprises:

a support shaft inside the arm and extending in the first direction; and a carriage supported by the support shaft and movable in the first direction along the support shaft, the carriage including:

an extending portion extending from inside the arm to outside the arm through the carriage opening; and a frame mount connected to the extending portion, an embroidery frame holding a sewing workpiece being configured to be attached to the frame mount; and the recess is on an opposite side on the lower plate with respect to the lower-plate center in the second direction, the opposite side being a side toward the second opposite direction.

2. The sewing machine according to claim 1, wherein the input interface includes a first input interface for operating at least one motor; and the first input interface is on the particular side on the front plate with respect to a front-plate center in the second direction.

3. The sewing machine according to claim 2, wherein the input interface includes a plurality of first input interfaces; and all of the plurality of first input interfaces are on the particular side on the front plate.

4. The sewing machine according to claim 2, wherein the input interface further includes a second input interface for performing an operation different from an operation of the motor; and the second input interface is on the particular side on the front plate.

5. The sewing machine according to claim 4, wherein the second input interface includes a plurality of second input interfaces; and all of the plurality of second input interfaces are on the particular side on the front plate.

6. The sewing machine according to claim 2, wherein a take-up opening is in the first side plate, the first side plate being a plate at an end of the arm in the second opposite direction; and the sewing machine further comprises a thread take-up lever in the take-up opening.

7. The sewing machine according to claim 2, wherein a lever opening is in the second side plate, the second side plate being a plate at an end of the arm in the second particular direction; and the sewing machine further comprises:

a threader configured to thread a thread through an eye of a sewing needle;

a lever through the lever opening and configured to, when operated, cause the threader to thread the thread through the eye; and a presser foot, the lever is configured to, when operated, cause the presser foot to move to a particular position and cause the threader to thread the thread through the eye.

8. The sewing machine according to claim 1, further comprising a horizontal hook inside the bed, wherein a hook opening is in an upper plate, the upper plate being a plate at an upper end of the bed, the hook opening being an opening for inserting a bobbin into the horizontal hook.

9. The sewing machine according to claim 1, wherein the frame mount is between the bed and the arm in the upper-lower direction, and an embroidery frame holding a sewing workpiece configured to be attached to the frame mount, and the frame mount is configured so that the embroidery frame is attached to the frame mount by inserting the embroidery frame toward the first opposite direction.

10. The sewing machine according to claim 1, further comprising a base at a position spaced below the bed, the base extending from a first end to a second end in a U-shape opening toward the first opposite direction, each of the first end and the second end being connected to the column.

11. A sewing machine comprising:

a column extending in an upper-lower direction;

a bed extending in a first particular direction from the column, a first direction including the first particular direction and a first opposite direction opposite to each other, the first direction being perpendicular to the upper-lower direction;

an arm extending in the first particular direction from the column at a position spaced upward from the bed, the arm including a first side plate and a second side plate, the first side plate extending in the first particular direction and in the upper-lower direction, the second side plate extending in the first particular direction and in the upper-lower direction, the second side plate being spaced apart from the first side plate;

an input interface on a front plate, the front plate being a plate at an end of the arm in the first particular direction, the front plate extending to an end of the first side plate in the first particular direction and extending to an end of the second side plate in the first particular direction, the front plate extending in the upper-lower direction and in a second direction, the second direction being perpendicular to the upper-lower direction and the first direction, the input interface being an interface for operating the sewing machine; and a carriage movable in the first direction, the carriage including a frame mount between the bed and the arm in the upper-lower direction, an embroidery frame holding a sewing workpiece configured to be attached to the frame mount, the frame mount being configured so that the embroidery frame is attached to the frame mount by inserting the embroidery frame toward the first opposite direction, wherein the carriage is connected to the arm on a side toward a second particular direction with respect to a center in the second direction, the carriage being not connected to the arm on a side toward a second opposite direction with respect to the center in the second direction, the second direction including the second particular direction and the second opposite direction opposite to each other.

12. The sewing machine according to claim 11, wherein a take-up opening is in the first side plate, the first side plate being a plate at an end of the arm in the second opposite direction; and the sewing machine further comprises a thread take-up lever in the take-up opening.

13. The sewing machine according to claim 11, wherein a lever opening is in the second side plate, the second side plate being a plate at an end of the arm in the second particular direction; and the sewing machine further comprises:

a threader configured to thread a thread through an eye of a sewing needle; and a lever through the lever opening and configured to, when operated, cause the threader to thread the thread through the eye.

14. The sewing machine according to claim 11, further comprising a lower plate extending in the first particular direction from a lower end of the column, wherein the bed is a cylinder bed above the lower plate, a space being between the cylinder bed and the lower plate.

15. The sewing machine according to claim 11, wherein the input interface includes a first input interface for operating at least one motor; and the first input interface is on a particular side on the front plate with respect to a front-plate center in the second direction, the particular side being a side toward the second particular direction.

16. The sewing machine according to claim 15, wherein the input interface includes a plurality of first input interfaces; and all of the plurality of first input interfaces are on the particular side on the front plate.

17. The sewing machine according to claim 11, wherein the front plate is perpendicular to the first opposite direction.

* * * * *